US012385250B2

(12) United States Patent
Al-Haboobi

(10) Patent No.: US 12,385,250 B2
(45) Date of Patent: Aug. 12, 2025

(54) MODULAR BUILDING PANELS WITH BUILDING SERVICES

(71) Applicant: Mustafa Mohammed Ali Al-Haboobi, Mississauga (CA)

(72) Inventor: Mustafa Mohammed Ali Al-Haboobi, Mississauga (CA)

(73) Assignee: 2837929 Ontario Limited, Mississauga (CA)

( * ) Notice: Subject to any disclaimer, the term of this patent is extended or adjusted under 35 U.S.C. 154(b) by 0 days.

(21) Appl. No.: 18/486,153

(22) Filed: Oct. 12, 2023

(65) Prior Publication Data

US 2024/0318428 A1 Sep. 26, 2024

(51) Int. Cl.

| | |
|---|---|
| ***E04C 3/06*** | (2006.01) |
| ***E04B 1/08*** | (2006.01) |
| ***E04B 2/58*** | (2006.01) |
| ***E04C 2/52*** | (2006.01) |
| ***E04C 3/32*** | (2006.01) |
| *E04B 2/74* | (2006.01) |
| *E04C 3/07* | (2006.01) |

(52) U.S. Cl.

CPC ..... *E04C 3/065* (2013.01); *E04B 1/08* (2013.01); *E04B 2/58* (2013.01); *E04C 2/52* (2013.01); *E04C 2/521* (2013.01); *E04C 3/32* (2013.01); *E04B 2002/7488* (2013.01); *E04C 3/07* (2013.01)

(58) Field of Classification Search

CPC ..... E04B 1/08; E04B 2/58; E04B 2002/7488; E04C 2/52; E04C 2/521; E04C 3/32; E04C 3/07; E04C 3/065

See application file for complete search history.

(56) References Cited

U.S. PATENT DOCUMENTS 3,738,678 A * 6/1973 King ..... B62D 25/2054 296/204
3,774,631 A * 11/1973 Willkins ..... F16L 1/10 137/357
4,919,164 A * 4/1990 Barenburg ..... E04B 2/82 137/15.08
5,076,310 A * 12/1991 Barenburg ..... E04B 2/82 137/15.08
5,488,809 A * 2/1996 Lindsay ..... E04B 5/14 52/143
6,951,079 B2 10/2005 Weiss (Continued)

FOREIGN PATENT DOCUMENTS

CA 2208391 C * 4/2002 ..... E04B 2/7457

*Primary Examiner* — Jessie T Fonseca
(74) *Attorney, Agent, or Firm* — Richard G. Topolewski

(57) ABSTRACT

Modular panels with custom metal frame members having cutouts to accommodate building services. These modular panels are open for visual inspection and can be used in various construction applications such as floors and walls. The cutouts in the metal frame members allow for the routing of building services such as plumbing, wiring, fire sprinkler, HVAC, whether rigid or flexible. The modular construction process involves the placement of module panels at a build site and the joining of building services between adjacent panels. Additionally, the system may incorporate a building information modeling (BIM) system that generates electronic models of buildings with modules and corresponding framing components.

3 Claims, 14 Drawing Sheets

(56) References Cited

U.S. PATENT DOCUMENTS

| | | | | |
|---|---|---|---|---|
| 8,978,324 | B2 * | 3/2015 | Collins | E04C 2/521 52/404.1 |
| 11,585,091 | B2 * | 2/2023 | May | E04B 1/08 |
| 2005/0188632 | A1 * | 9/2005 | Rosen | H02G 3/388 52/220.2 |
| 2008/0104901 | A1 * | 5/2008 | Olvera | E04C 2/521 52/173.1 |
| 2010/0229472 | A1 * | 9/2010 | Malpas | E04C 2/521 52/173.3 |
| 2010/0263308 | A1 * | 10/2010 | Olvera | E04C 2/521 52/220.2 |
| 2011/0296778 | A1 * | 12/2011 | Collins | E04C 2/521 52/745.1 |
| 2014/0069035 | A1 * | 3/2014 | Collins | E04B 2/72 52/745.1 |
| 2021/0246652 | A1 * | 8/2021 | May | H02G 3/04 |
| 2021/0404183 | A1 * | 12/2021 | May | E04B 2/58 |
| 2023/0383535 | A1 * | 11/2023 | Griechen | E04B 2/721 |
| 2024/0076872 | A1 * | 3/2024 | May | E04B 1/08 |

* cited by examiner

MODULAR BUILDING PANELS WITH BUILDING SERVICES

BACKGROUND OF THE INVENTION

Technical Field

The present disclosure relates generally to modular building, and more particularly, to an improved system of modular panels for building.

Background

Modular construction has been garnering increasing attention as a pivotal area of growth in the construction industry. The predominant form of modular construction today is volumetric, focusing on the assembly of three-dimensional units in an off-site location before their integration on-site. In contrast, panelized modular construction typically has been limited to the shell, frames, and occasionally the inclusion of exterior insulation and windows.

The integration of building services such as electrical, plumbing, heating, ventilation, and air conditioning (HVAC), and fire protection into panelized modular construction brings significant benefits. However, it simultaneously presents distinct challenges, particularly relating to the multiple disconnection points for these services within a modular panel. Moreover, the requirement for these panels to be inspected and certified at the manufacturing location before they can be approved for installation on-site adds an extra layer of complexity. This can increase both the time and cost associated with the panels, altering the traditional building process which usually involves on-site inspection.

Despite the potential advantages that panelized modular construction offers, such as greater design flexibility, easier and cheaper transportation compared to volumetric modules, and compatibility with a range of materials for framing, current practices in the industry do not fully capitalize on these benefits. Challenges associated with precise cutting and measurement for integration of services, the need for off-site certification and inspection, and the complexity of managing multiple disconnection points continue to impede the broader adoption of modular panel construction.

What is therefore needed is a module panel design that circumvents the need for inspection and certification at the manufacturing plant, while providing a solution that aligns with the standard local building inspection requirements.

SUMMARY OF THE INVENTION

A modular construction including a module panel having a length, a width, and a shorter cross-sectional depth, where the module panel is open for visual inspection. The module panel has a customized metal frame member, where the customized metal frame member has a cutout, and where the cutout enables a building services to route through the customized metal frame member.

The modular construction system may include a building service installed in the module panel. The custom metal frame member may be formed from a roll of metal. The sides of the module panel may be open for visual inspection. The custom metal frame member may be made using a steel-roll forming machine with stations that create cutouts. The module panel has a final orientation and the cutout may be longer in one dimension to accommodate ridged building services to move vertically when in the final orientation. The module panel may be a floor section with the customized metal frame member being joists. The module panel may be a wall section with the customized metal frame member being studs. The building services may be rigid building services. The building service may be flexible building service and cut to a length to enable joining of the building services to a corresponding building service of another module panel. The flexible building service may be wound-up and may be located inside the module panel.

A modular construction process includes providing a first module panel with a frame member having cutouts and a building service routed through the cutout. Placing the first module panel in a final location at a build site. Providing a second module panel with a second frame member having a cutout and a second building service routed through the cutouts. Placing the second module panel in a second panel final position. Joining the first building service with the second building service.

The modular construction process may also include providing a module panel and corresponding finishing materials, where the corresponding finishing materials are arranged in an order that facilitates closing the module panel. The process may include installing the corresponding finishing material on the module panel in a predetermined pattern. The modular construction process where the module panel has a bottom, a top and a bottom left; and the predetermined pattern starts in the bottom left going up to the top and then moving right and start at the bottom and going up to the top and repeat pattern.

The system may include a building information modeling system with an electronic model of a building using modules and corresponding framing components with the modules being composed of framing members and the framing member include cutouts for building services, and the corresponding framing components cover the modules. The system also includes a list of customized metal framing member for creating the modules where the list of customized metal framing member is based on the electronic model. The system also includes a list of framing components including cutouts where the framing components will cover the.

DETAILED DESCRIPTION

Figure 1:
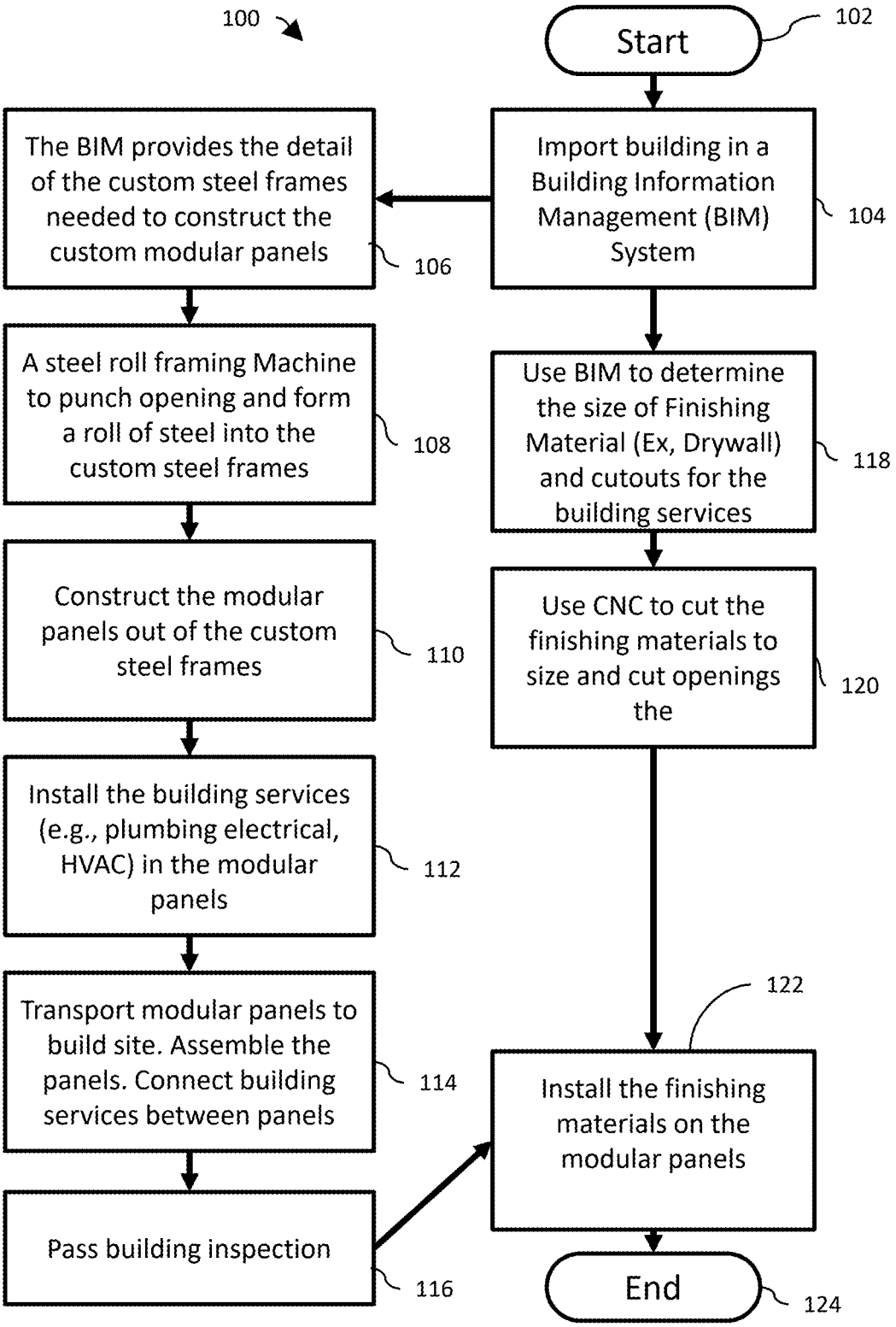
FIG. 1 provides a high-level process flow for the modular panel construction system.

FIG. 1 presents a flowchart 100 which demonstrates a high-level process flow for a modular panel construction system. The system enables adding building services (for example, Mechanical Electrical Plumbing and Fire suppression, MEP-F) into prefabricated modules.

The process starts at oval 102. Following the oval 102 is box 104.

At box 104 the building design may be imported into a Building Information Management (BIM) System. Panelized framing is not limited to platform framing, the framing can be standard framing, balloon framing or any other types of framing.

Design of the building services (like plumbing) may take into consideration the overall limitations of the modular paneling method implementation and trying to minimize crossing between panels by design knowing that crossing cannot be entirely avoided.

It is preferable to have the least amount of module panels. Whenever possible it is preferable to have the wall modules continuous from wall to wall. Preferably the floors are cut based on O.C. (on center) multiples so the end caps of the module are a joist needed for structural purposes for the final assembled structure.

The BIM may be used for the process, and the module is unique in relying on uniquely designed cut-out stations for hole cutting and other cut-outs. This unique stations allows the translation of BIM data directly to the rolling machine for cutting and punching. Examples for such stations or molds may be for electrical receptacles, lights, plumbing, fire sprinklers, etc.

For non-structural walls and for case of construction, the top plate of walls may have much longer flanges and may come with elongated holes situated exactly where the top plate meets the studs. The purpose of this shape is account for any variations in height that may occur from the different types of structural flooring used, for example: The bow in precast concrete, or the fire rated ceiling in steel joist etc. This adjustable height top plate wall enables non-structural walls to be installed after the erection of structural elements and the shell. This feature mirrors the staging process of conventional construction, thus offering familiarity for inspectors and workers, and aiding in permit acquisition and financing procedures. It also substantially decreases the high upfront costs generally associated with modular or prefab construction, where multiple trades or services are often required to work concurrently within a factory setting. Importantly, this financial advantage is an optional feature facilitated by the proposed precast method. The system also bypasses the structural limitations that typically dictate the number of stories for which a modular or prefab system can be designed. Furthermore, it facilitates the use of the modular prefab method in retrofitting and renovation scenarios, thereby demonstrating its adaptability to various construction contexts.

From box 104, the flowchart splits into two distinct pathways.

The first pathway leads to box 106, where the BIM system provides the necessary details for fabricating custom steel members for modular panels.

This system needs precise cuttings and measurements, while this can be achieved manually, the method is best suited to be designed in Building Information Modeling (BIM) software to accurately measure and calculate. The system will also work best with use of Computer Numerical Controlled (CNC) machines for steel or wood framing cuttings with data provided by the BIM software.

A module panel can be a floor, a wall, bulkhead, fake wall, etc. Modular panels may have integrated building services (Mechanical/Electrical/Plumbing/Fire-protection, MEP-F). The modular panels are designed for prefabricated panelized assembly. Individually, the modular panels do not create volumetric modular structures.

The modular panel can be of any sturdy material that is acceptable for construction, for example steel, wood, etc. An exterior wall modular panel may include insulation, vapor barrier, drywall and cladding added at the factory. Floor modular panels may include the subfloor added at the factory. Roofs modular panels are most recommended for flat roofs as it is easier to divide a flat roof into modular panels.

Modular panels, in contrast to volumetric modules, are able to support more diverse designs and have less limitations as the design is not confined to a box or rectangular shapes as is typical in volumetric modular construction.

Building services (line, pipe, duct, wire, etc.) that crosses between modules can be referred to as a crossing point. Crossing line or crossing point or crossing plane or crossing pipe, wire or duct etc. is defined as the crossing point or planar cross in-between two modules that will be connected at the construction site. Example, crossing pipe is the pipe that crosses between two module panels.

After designing the building the BIM software may be used to identify the modular panels and the connection points between the modules. At connection points any wire crossing between modules is referred to as crossing wire, that is wires that cross between the modular panels.

Next at box 108, a steel framing machine creates custom frame members as indicated by the BIM system by punching the requisite openings from a big role of flat steel and forming C-channel of the required cross section lengths, with the openings in the desired locations.

Many types of materials can be used for the frame members of the module panels, for example, wood or tubular steel etc., this system allows for use of light gauge steel as the structural element which reduces the cost as compared to volumetric modules.

Next at box 110, the modular panels are constructed using the custom frames members. The system implements building services, MEP-F, in modular panels in the factory. The module panel can be framed manually or preferably using machines driven by data from BIM software that punches, cut and drills any holes needed in the module panel. The use of BIM software can increase the accuracy of the results.

A wall frame module panel is standard framed wall at factory. The wall module panels may be structural or non-structural, a partition wall. Wall modular panels going the width of the wall may be the most efficient.

The floors are preferably joists with cut holes precisely especially for plumbing and drain slope. Open web could rearrange the opening web The floor joist are to be connected by bridging or linear connectors. Subfloors can be added at the factory or at the construction site. The floor to start with a joist and ends with a joist preferably to avoid caps on the end. The bridges or connectors are to be added at the construction site in order to tie the different floor modules together.

Roof to be done at factory in parts, parts are the ceiling joist and other parts are the roof rafters, this enables the whole roof to be done as in modular panels.

Next at box 112, the building services are installed into the panels.

Next at box 114, the constructed modular panels with building services are transported to and assembled at the building site.

The transportation of modular panels can be much easier, cheaper and faster than volumetric modules. Modular panels dimensions may be limited by transportation and construction site logistic. Panels of up to 50 ft in one dimension is possible to transport using standard means. The width and height of the panel is less restricted, generally, the restriction is in transportation laws per local codes.

At the construction site, the modular panels undergo final processing and installation. The panels are assembled and the building services between panels are connected to form a complete building. Both the assembly and installation of the modular panels must adhere to the locally applicable standards, building practices, and building codes specific to the jurisdiction of the construction site.

Next at box 116 the local building inspector comes to the build site and verifies that the assembled structure adheres to all relevant local building codes and safety standards.

The module panel, either floor or wall, has at least one-side open, meaning the module panel is able for inspection at the construction site after incorporated into an assembled structure.

Subject to the local authority in each jurisdiction, by having the MEP-F exposed by at least one side of walls or ceiling, for example at the internal sides of walls and ceilings, the prefabricated modular panels may meet the definition of local standard. In Canada, they might align with the definition of "prefabricated open panel" as defined by the Canadian Standards Association CSA in its standard for modular paneling A277-16 (2021) in A.3 Definitions. Similarly, in the United States, such panels could adhere to standards or guidelines as stipulated by the International Code Council (ICC) or the National Fire Protection Association (NFPA) related to modular construction.

By meeting the definition of "prefabricate open panel" can results in bypassing the requirements in some jurisdictions for the certifications for modular construction which reduces the cost, time and complexity of projects. Having the modular panels open at least on one side makes it easy for local inspectors at construction sites to inspect which provides the option to bypass the requirement for additional licensing for factory modular construction as all services are still exposed after transportation to the construction site and can be inspected other standard onsite construction.

The addition of the MEP-F into modular panels with one side open for inspection enables the modular construction of a buildings from modular panels using local inspector, as opposed to volumetric modules, and can bring the benefits of modular panels to a wider audience.

In parallel to the sequence from box 106 to box 116, a second pathway is running from box 118 to 120.

At box 118, the BIM system provides the dimensions and cutouts for the finishing materials.

Next at box 120, a Computer Numerical Control (CNC) machine, guided by the BIM information, cuts the finishing materials to the desired dimensions and shapes.

The finishing materials (for example, precut drywall or panel board) maybe precut and pre-routed to be sent to construction site, due to the knowledge of the openings and their locations on the interior panels, the cuts to the finishing material can be made precisely in factory and sheeting panels can be sent to the construction site. pre-cut and pre-routed ready to be installed without the need to cut holes or panel sizing on-site, this will reduce cost and debris at the construction-site.

The precise cuts can be done manually but using a CNC machinery is preferable and possible since the information for holes and cuts can be imported from the design software.

Cutouts may be for building services access, for example fire sprinkler pipe holes.

Both pathways from boxes 106-116 and 118-120 converge at box 122. At this point, the finishing materials are installed on the assembled structure.

Finally, the process concludes with the end oval 124.

Figure 2:
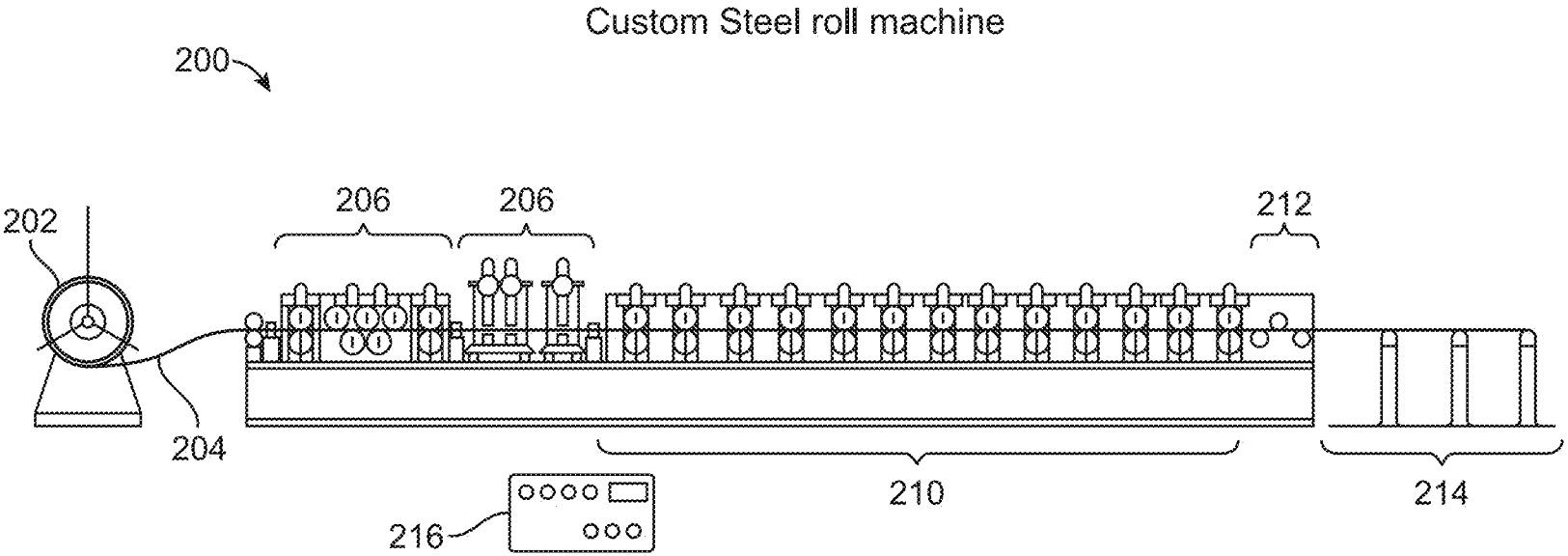
FIG. 2 is a drawing of a steel roll forming machine that makes custom metal frame members.

FIG. 2 shows a steel rolling machine 200 that takes a continuous sheet of metal 204 off a coil of steel 202 The sheet of steel 204 progresses through a series of flattening rollers 206. Subsequently, a series of stamps 208 create cut-out openings in the sheet of steel 204. This sheet of steel 204 then moves to a series of rollers 210, which shape it into specific structural components, such as a metal 2×4 stud member or a 2×6 joist member. The cut-out openings in these components accommodate building services. Following the rolling process, a cutter 214 trims the shaped frame member to the desired length. The finished frame member may then be accumulated on the finished product stand 214. A numerical control system 216 oversees and manages the entire process described, ensuring precision and consistency in the end product.

The steel rolling machine may employ various mechanisms or configurations for bending, stamping, and shaping the sheet of metal. For example, alternative mechanisms or methods could be used to achieve the necessary flattening or smoothing of the steel sheet. The sequence of operations may vary, with stamping or cutting of openings occurring either before, concurrently, or after the rolling or cutting process. The steel rolling machine may produce a diverse range of metal structural components, with varying dimensions, profiles, and features. Variations in the type of metal, its thickness, and other physical characteristics, may necessitate adjustments or modifications to the roll forming process. The machine may incorporate different control systems or algorithms to enhance precision, reduce waste, or optimize production speed.

Cut-outs openings for electrical receptacles, switches and other electrical equipment that is mounted to a steel element. The purpose of these cut outs is to pre-determine the location of the electrical box or equipment which provides the accuracy and the ability to cut wires to length by predetermining the wires route and knowing the start and end points of the wire. This allows for the whole process be efficient in term of material and time. The cut-out openings allow for mounting the boxes and gadgets that needs to be mounted for the rough-in inspection at the construction site.

Cutouts may be for light junction boxes to specify their locations, same way as electrical receptacles.

Cutouts may be for plumbing/fire water lines and Drain, Waste, or Vent (DWV) pipes which will allow for easier prefabrication of the plumbing in the particular module.

Figure 3:
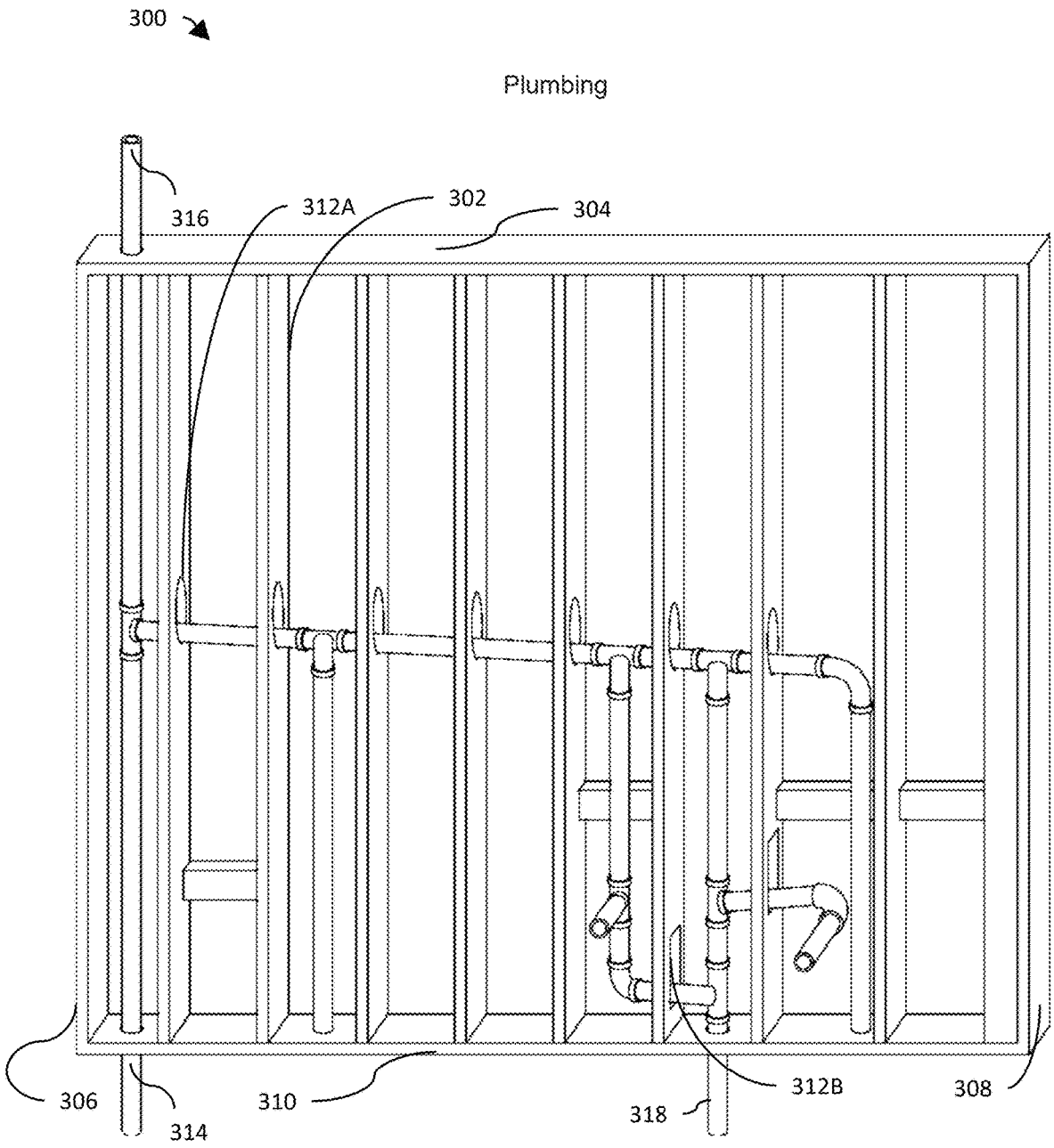
FIG. 3 illustrates a modular panel with customized metal frame members having elongated cutouts for plumbing drain piping services.

FIG. 3 illustrates a plumbing modular panel 300 with customized metal frame member 302 having a top cap 304, a left frame member 306, a right frame member 308, and a bottom cap 310. The metal frame member 302 has an elongated cutout 312A for plumbing drain pipes for DWV. The DWV module panel 300 also has square elongated cutout 312B. The DWV module panel 300 has a down vent pipe 314, and an up connection vent pipe 316, and a down connecting drain pipe 316.

Plumbing building services may include water lines that may be any regular construction standard for potable water, and flexible material allowed by local building code is recommended, for example Cross-linked polyethylene (PEX).

The plumbing may be installed in each modular panel based on drawings and the custom frame pre-cut openings The crossing plumbing elements are to be connected at the construction site. The plumbing lines should fit and connect precisely, while this can be achieved manually at the factory by being mindful of dimensions and following the drawings, the preferred method is using BIM software to model the openings and slope, this will minimize the error at the construction site when connecting the plumbing.

Plumbing pipes that are completely within the modular panel may be installed in the modular panel factory. There are at last two ways to join the DWV pipe that cross between the modular panels.

When a DWV pipe goes from vertical wall panel to horizontal floor or when the DWV pipe changes direction at the cross point between two panels, then the plumbing connection (90 elbow or other type of connections) can either be connected on one side of the panel and the other side is to be connected at the construction site or the connection plumbing to be totally connected at the construction site.

If a plumbing line is crossing perpendicular between the edges of two panels (for example crossing between two floor panels modules) then there are at least two approaches. The first approach is to cut the pipe at the intersection then use a plumbing connector to connect the different module panel's pipes at the construction site. The second approach is to Do not install the pipe and mark it for installation at the construction site.

The cutouts in the frame members may be elongated holes may facility installation at the construction site, these elongated holes may allow the movement of the plumbing elements vertically to facilitate easy assembly at the construction site.

Cutouts may be for rigid pipes, where the rigid pipes are used for fire sprinkler, plumbing or gas.

Figure 4:
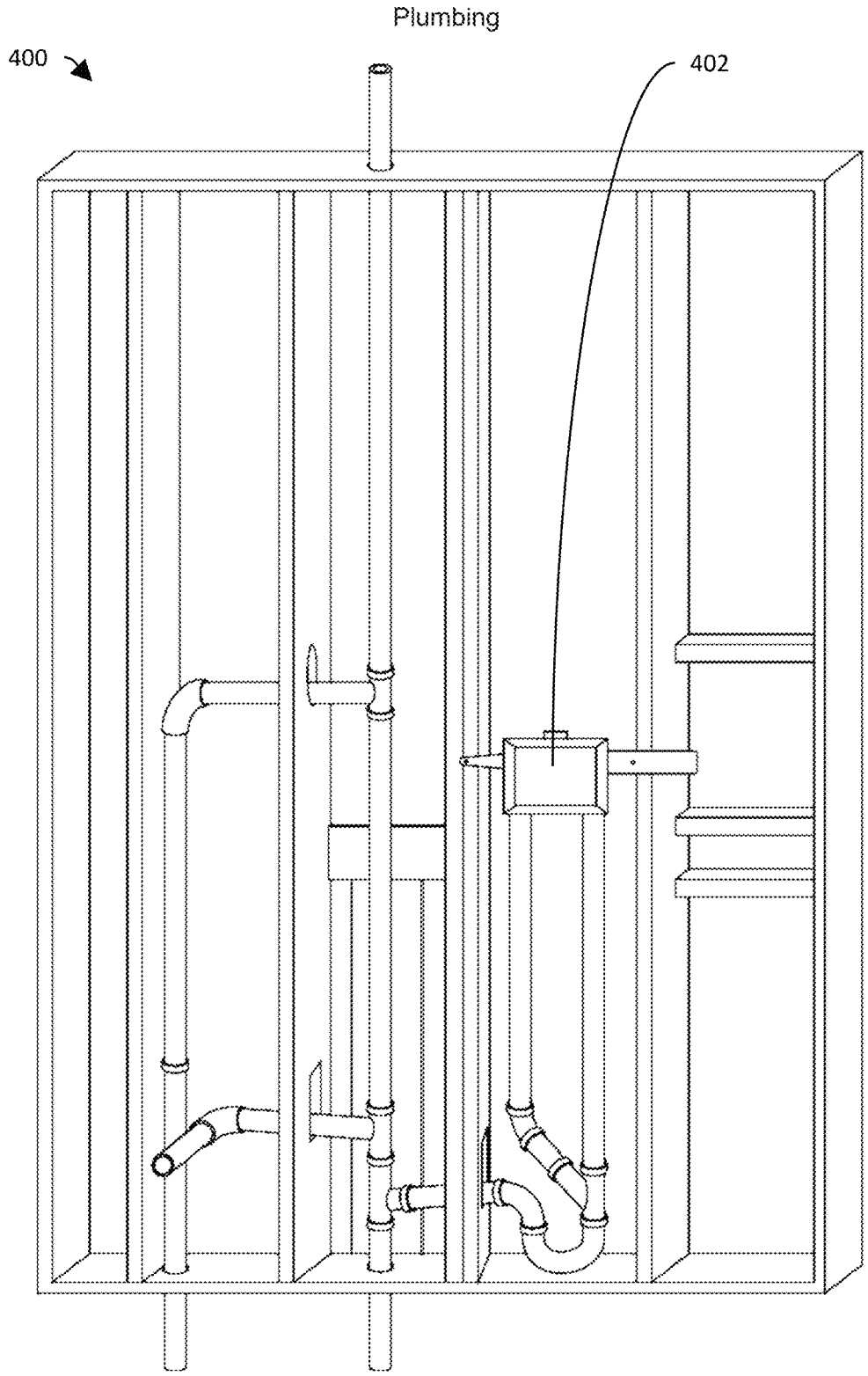
FIG. 4 illustrates a modular panel with a building service access, in this case a laundry drain access.

FIG. 4 illustrates a modular panel 400 with a building service access, in this case a laundry drain access 402.

Figure 5:
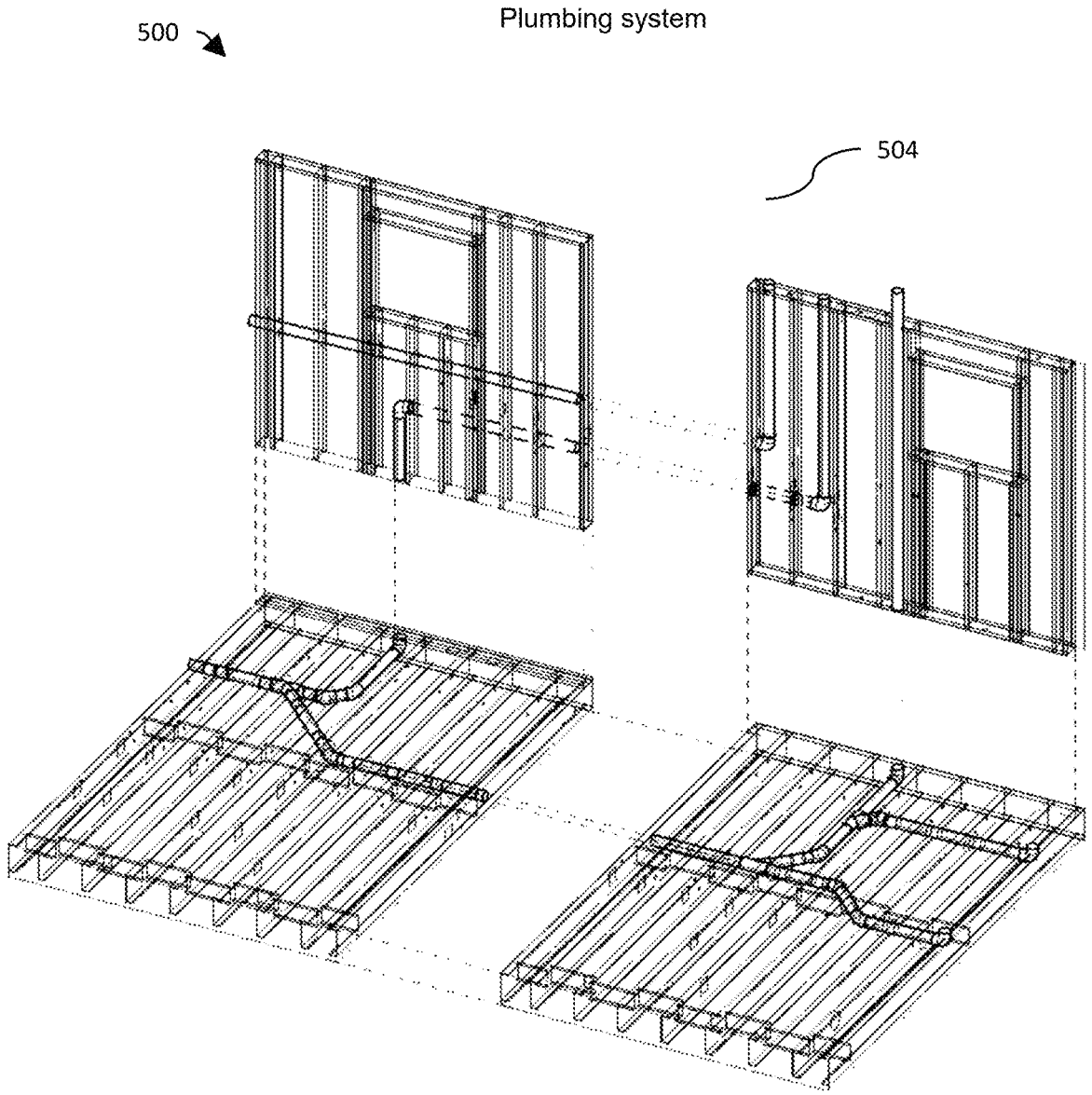
FIG. 5 illustrates a set of modular panels with rigid building services, specifically with drain plumbing.

FIG. 5 illustrates a set of modular panels with rigid building services, specifically with drain plumbing.

Figure 6:
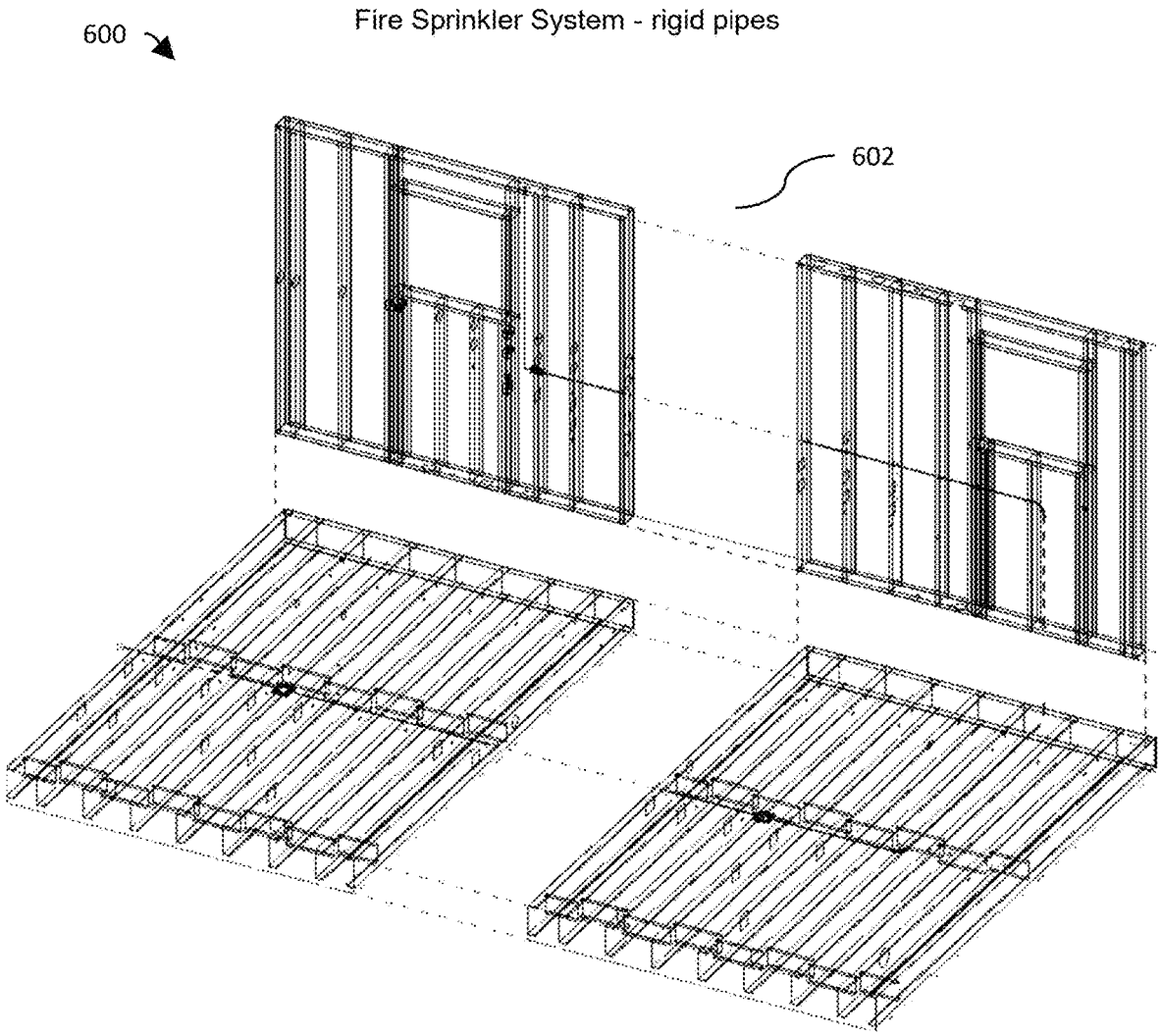
FIG. 6 illustrates a set of module panels with rigid building services, specifically with fire sprinkler services using rigid pipes.

FIG. 6 illustrates a set of module panels with rigid building services, specifically with fire sprinkler services using rigid pipes.

Fire protection building services may include sprinkler system.

Sprinkler lines may be connected at the factory as much as possible. The sprinkler head (and other components connected to the sprinkler system) can be connected at the factory but those components that may be damaged through transportation and should instead be connect it at the construction site. For example, extending sprinklers may be damaged during transportation so they should be installed at the construction site. But, concealed sprinklers may be installed at the factory as there is less of a chance of concealed sprinkler component being damaged during transportation.

Fire sprinkler systems can be designed with either rigid or flexible pipes. For those utilizing rigid pipes, two primary installation methods are available. Firstly, rigid sprinkler pipes can be cut at crossing points, enabling onsite connection through the use of elbow connectors, 180-degree connectors, or other suitable fittings. Alternatively, instead of being fully installed in the factory, rigid pipes can be fitted onsite. In this scenario, the factory ensures that the necessary openings are cut to provide adequate clearance for the rigid pipe installation.

For flexible pipes two primary installation methods are available. Flexible pipes that cross the designated area can be cut to a length that sufficiently reaches the opposite end and can be conveniently rolled within the panel. Another approach is to cut the flexible pipe at the crossing point, allowing it to be connected at the construction site through the use of connectors, similar to the method described for rigid pipes.

Figure 7:
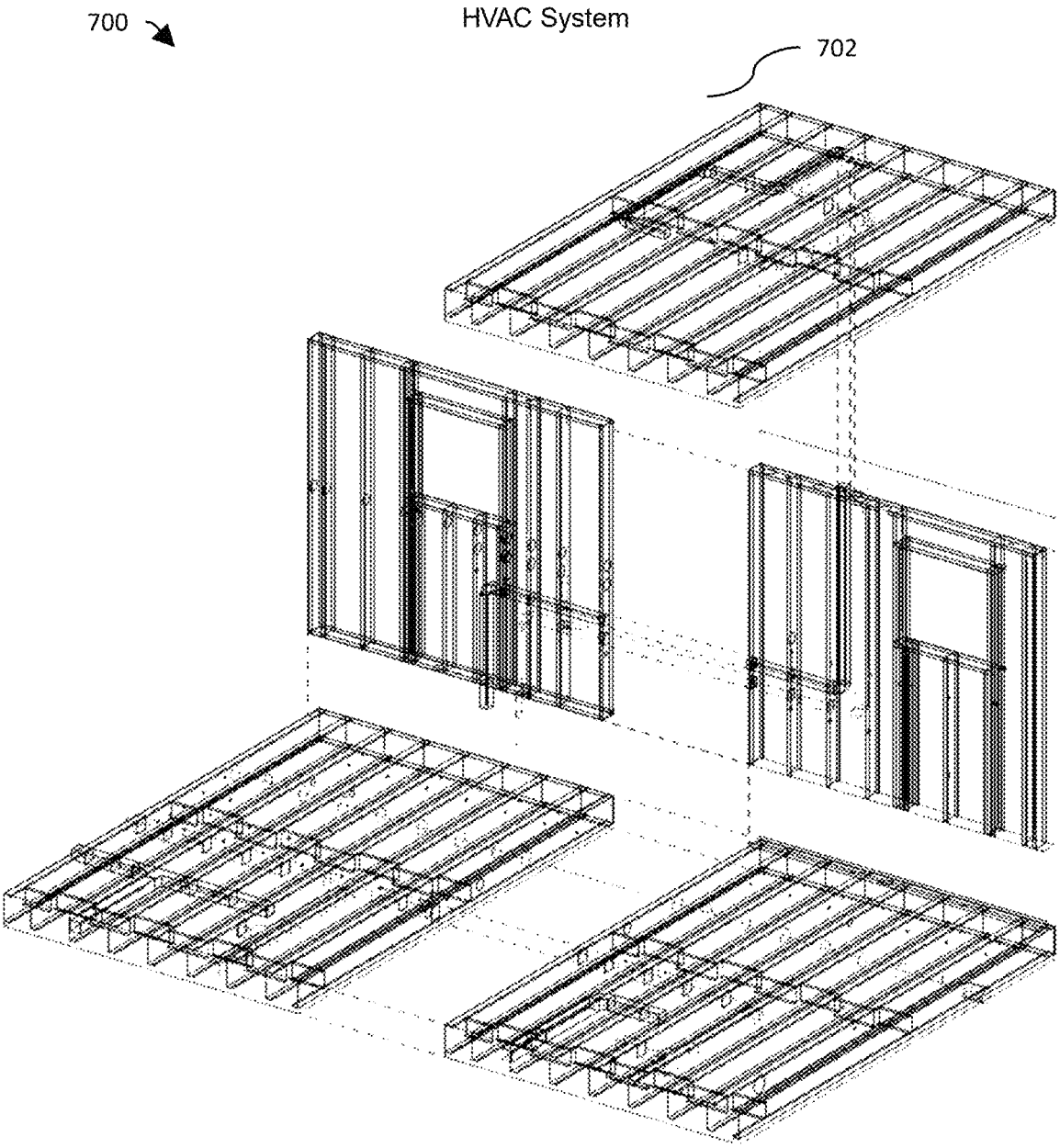
FIG. 7 illustrates a set of modular panels with rigid building services, specifically with HVAC ductwork.

FIG. 7 illustrates a set of modular panels with rigid building services, specifically with HVAC ductwork.

HVAC ducts may be implemented into the modular panels if a joist system is used (whether steel or wood).

If the HVAC ducts are implemented in the floor, then at the factory the HVAC ducts may be cut at the crossing line/plane of each module panel (typically a floor modular panel) and the ducts may be connected at the construction site with typical duct connectors.

If the HVAC ducts are implemented in bulkheads, then the HVAC may be fabricated at the factory and cut to length based on transportation limitation or assembly feasibility limits at the construction site. The ducts may be connected at the construction site with typical duct connectors.

In general, the crossing duct for HVAC can either be installed at the factory and cut at the crossing line/plane or the crossing HVAC duct can be installed at the construction site. If installed at the factory and cut then the ducts may be connected by duct connectors at the construction site. Because HVAC ducts are more forgiving in cut length then pipe, it is preferable to cut at the crossing plane and connect at the construction site.

Flexible HVAC ducts may be installed by cutting the hole in factory along the route of the flexible HVAC duct, the flexible HVAC duct may be "flexed" and installed at the construction site following the pre-cut holes.

Cutouts may be for HVAC, may be pre-determined sizing of the ducts systems, the HVAC openings can be cut at factory and the process can use rigid ducts or flexible ducts that span more than one module and to be installed at the construction site with holes already precut.

Figure 8:
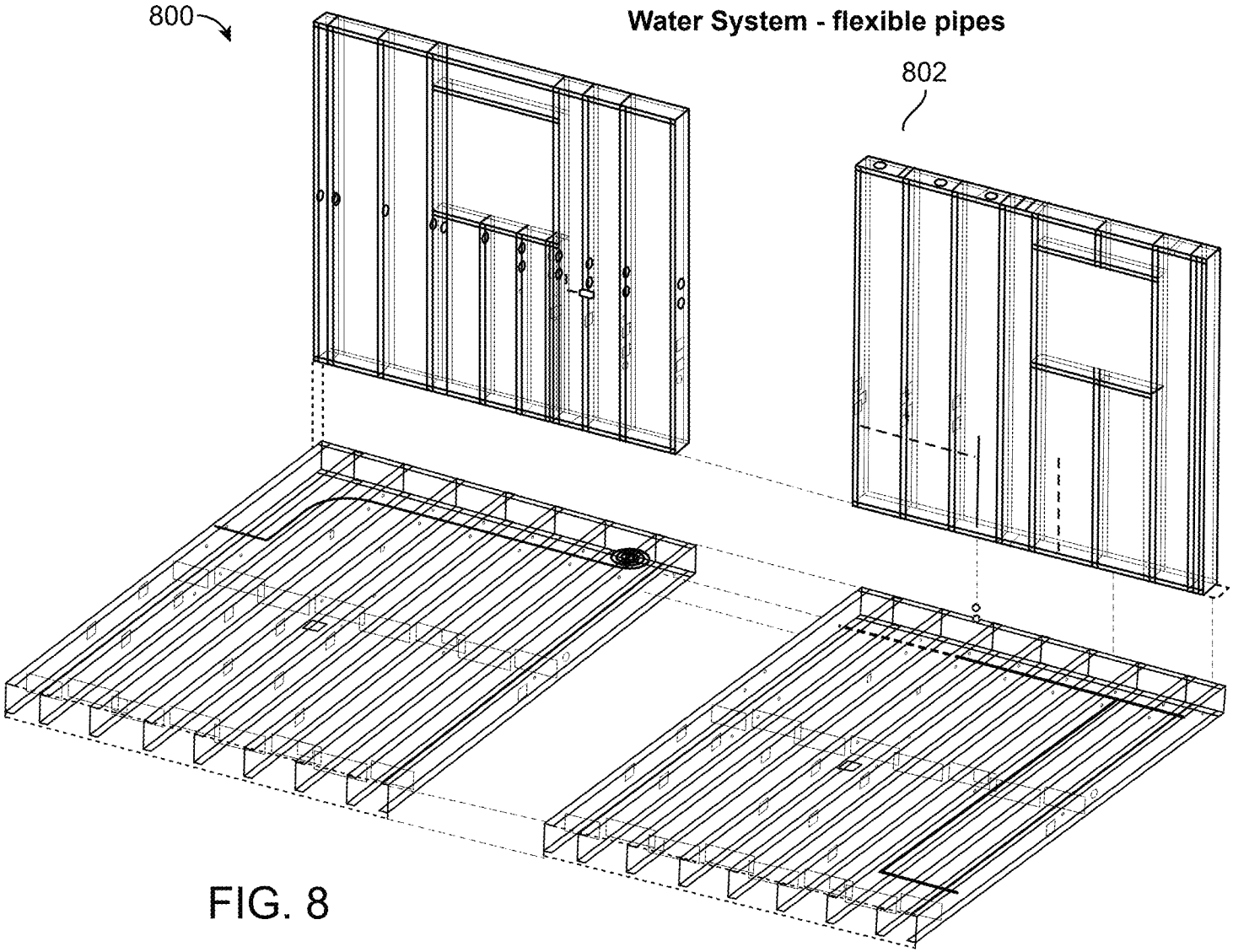
FIG. 8 illustrates a set of modular panels with flexible building services, specifically water supply plumbing with flexible pipe wound up inside the modular panels for transportation to the construction site.

FIG. 8 illustrates a set of modular panels with flexible building services, specifically water supply plumbing with flexible pipe wound up inside the modular panels for transportation to the construction site.

The water lines may be connected at the factory as much as possible. The faucets (or any water outlet) may be connected at the construction site.

When a water line crosses between modules (a first module and a second module), at least two options exist. First the crossing water line may be installed at the construction site. Second the crossing line to be connected on one side in a first module and stored in the first module and then later at the construction site the crossing line may be connected in the second module.

When a fitting is in the crossing line between the modules, at least two options exist. First the fitting may be installed at the construction site and not at the factory. Second the fitting may be installed on in the first module and stored in the first module leaving the connection to the second module to be done at the construction site.

Figure 9:
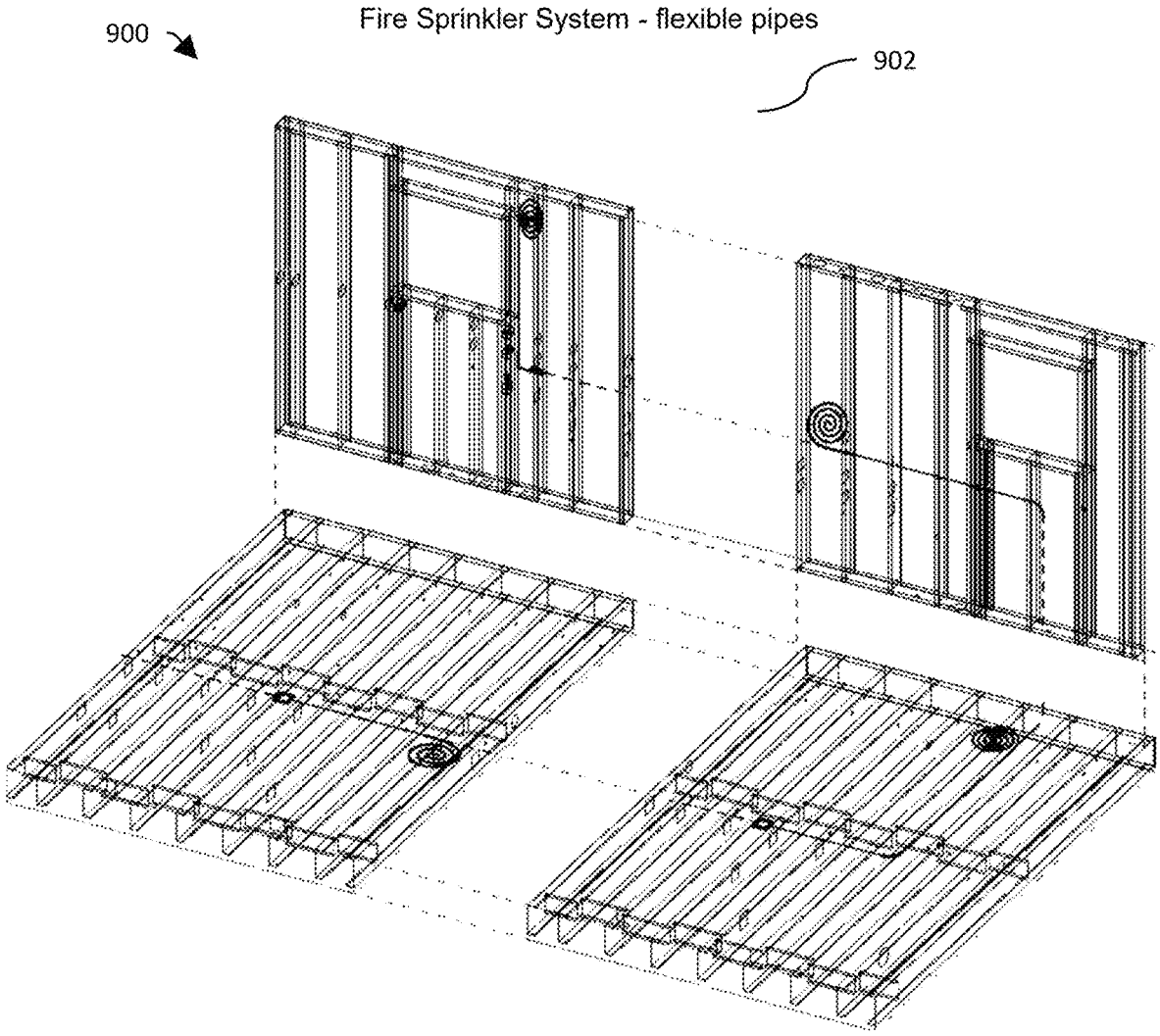
FIG. 9 illustrates a set of modular panels with flexible building services, specifically fire sprinklers with flexible pipes wound up inside the modular panels for transportation to the construction site.

FIG. 9 illustrates a set of modular panels with flexible building services, specifically fire sprinklers with flexible pipes wound up inside the modular panels for transportation to the construction site.

Figure 10:
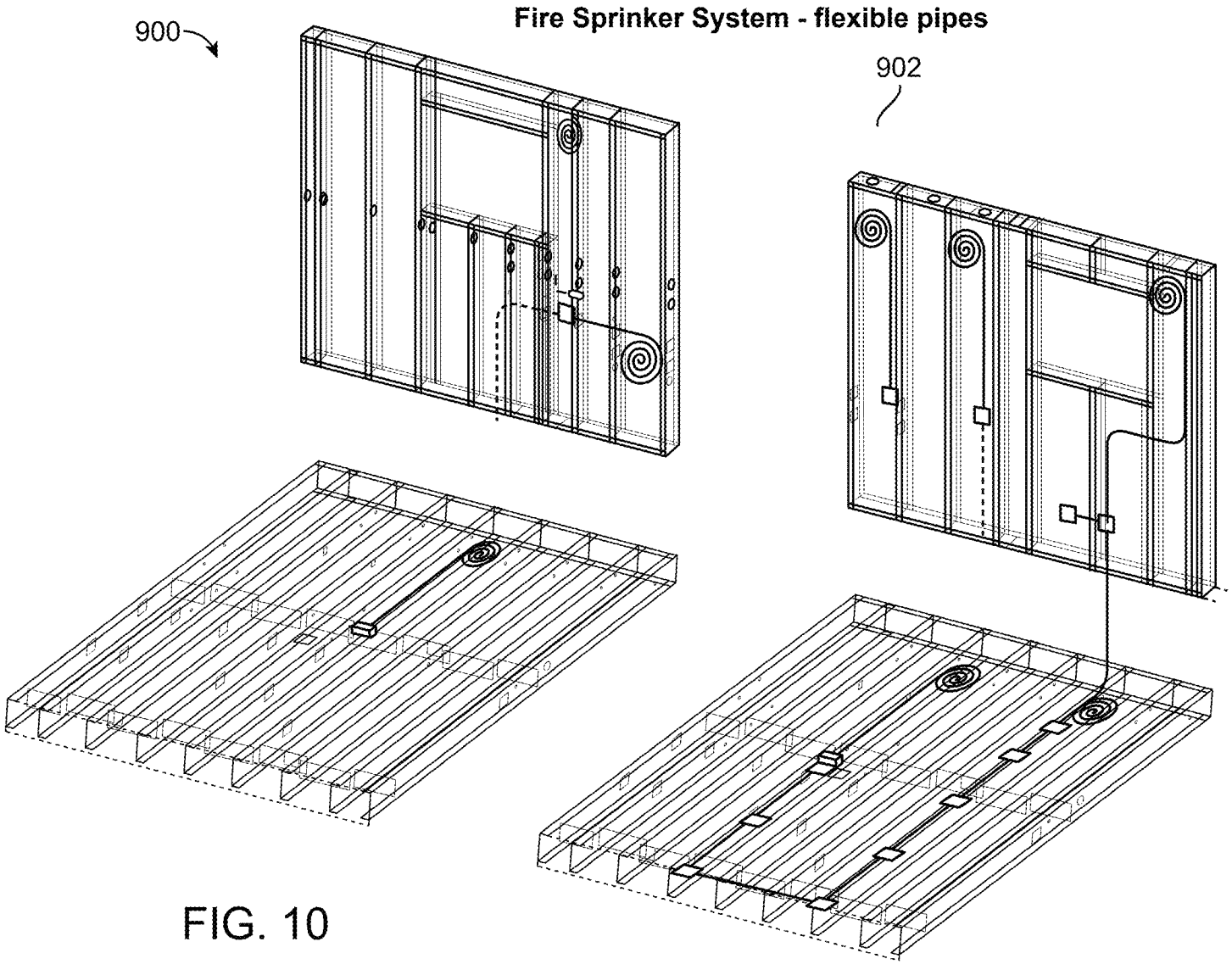
FIG. 10 illustrates a set of modular panels with flexible building services, specifically with electrical wiring wound inside for transportation to the construction site.

FIG. 10 illustrates a set of modular panels with flexible building services, specifically with electrical wiring wound inside for transportation to the construction site.

A wire direction is assumed between the outlets to help with the installation, the wires may be numbered on the design in the BIM software.

There are at least two methods to install the crossing wires, first partially at the factory or second completely at the construction site.

For the partially at the factory method, wire outlet #1 in the factory with the crossing wire connected physically to the outlet #1. Cut the crossing wire to a length that is suitable to reach outlet #2 and store the excess wire in the modular panel, for example the excess wire may be rolled up and stored in the modular panel. At outlet #2, complete the wiring as if the crossing wire was connected and connect the wires in the factory. Once at the construction site, complete the wiring at outlet #2 by connecting the crossing wire.

For the completely at the construction site, at outlets #1 and #2, hypothetically assume the crossing wire is connected and connect the wires in the factory. After transportation and installation of modules at the construction site, add the crossing wire to outlet #1 and #2.

Note: The assumption is outlet #1 in module #1 and outlet #2 in module #2, numbers are interchangeable. Modules can be farther away in the building structure. An outlet can be a plug, a switch, a light point, a fan etc.

Any wire connectors can be used for the electrical wiring. Push-in-connectors are recommended at the connection points where the crossing wire is to be physically connected at construction site.

The finishing of the electrical building services may be up to rough-in phase or the switches/plugs etc. may be by adding at the factory but these boxes may be without the cover plates.

The dedicated receptacles and the first outlet in a circuit may be wired at the outlet and need to be run to the breaker, or be wired at the breaker and need to be run to the dedicated receptacle or first outlet.

The electrical wiring at the factory may only be up to rough-in phase. The electrical wiring at the factory may be up to the installation phase with the installation of the outlet devices (switches, receptacles, light, fan, etc.). Whether the factory only complete to rough-in or installation phase may depend on the local codes at the build site and local required jurisdiction requirements for module certifications. Completing to installation phase in factory may require the factory to obtain the necessary certifications to manufacture modular structures as per the build site regulations. There may be an advantage of only completing rough-in at factory (leaving thee installation phase to be done at the construction site) in that it may avoid the complexity and cost and time of the manufacturing certification.

Figure 11:
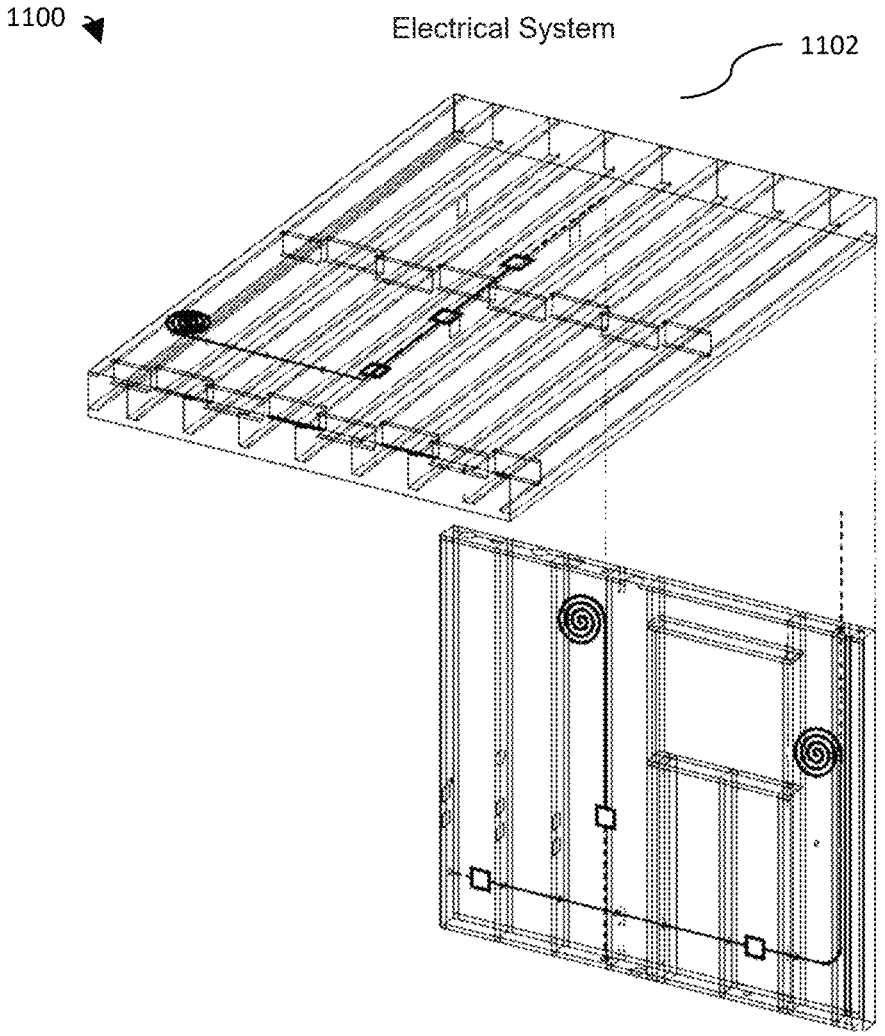
FIG. 11 illustrates a set of two modular panels (a wall and ceiling) with flexible building serves, specifically with electrical wiring wound inside the modular panels for transpiration to the construction site.

FIG. 11 illustrates a set of two modular panels (a wall and ceiling) with flexible building serves, specifically with electrical wiring wound inside the modular panels for transpiration to the construction site.

Figure 12:
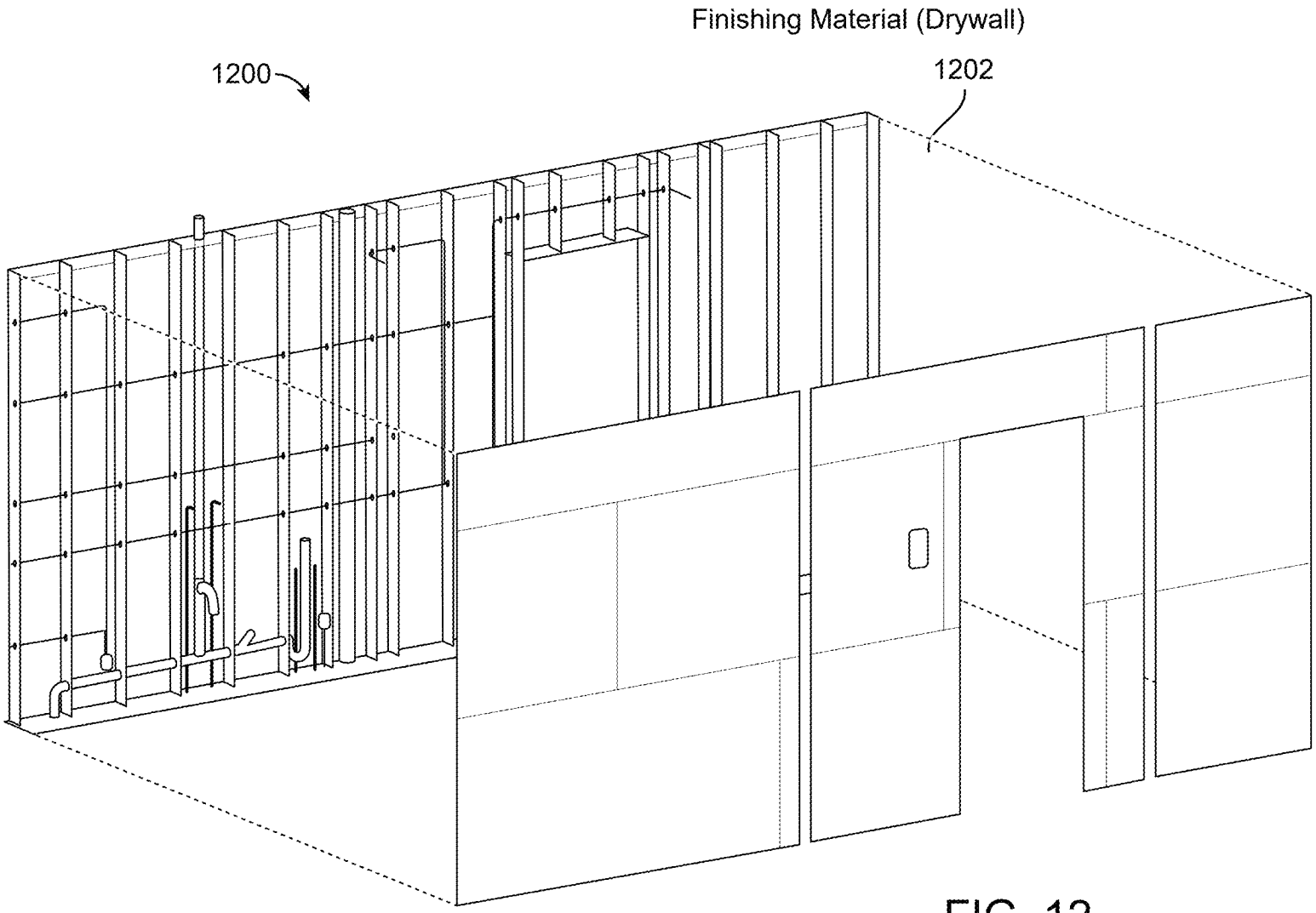
FIG. 12 illustrates pre-cut finishing materials (drywall) and how they will attach to the corresponding modular panels.

FIG. 12 illustrates pre-cut finishing materials (drywall) and how they will attach to the corresponding modular panels.

Figure 13:
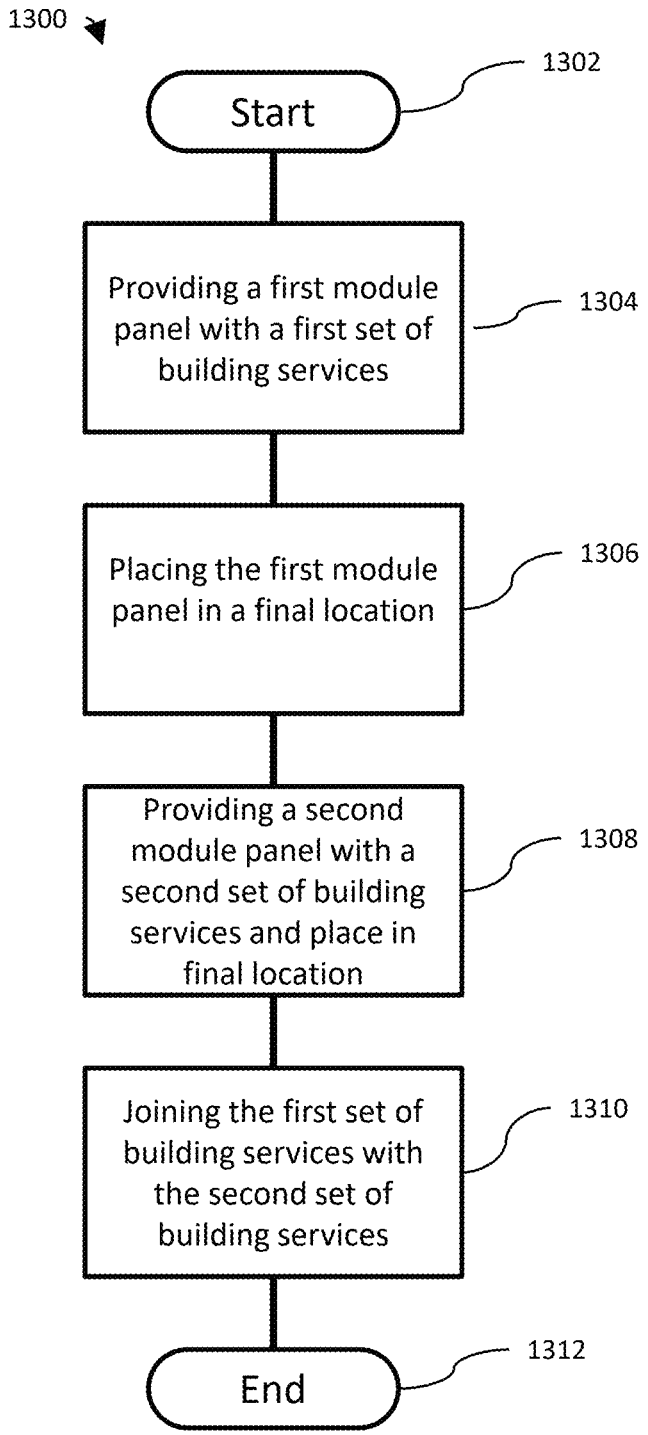
FIG. 13 provides a flow chart of how the modular panels can be assembled and the building services connected FIG. 14 provides a flow chart of how the pre-cut finishing materials (example, drywall) can be installed on the module panels.

FIG. 13 provides a flow chart of how the modular panels can be assembled and the building services connected After initiating at start oval 1302, the process advances to box 1304 where a first module panel equipped with a first set of building services is provided.

Next, at box 1306, the first module panel is positioned in its designated final location.

Following this, at box 1308, a second module panel, furnished with a second set of building services, is both provided and positioned in its respective final location.

Subsequently, at box 1310, the first set of building services is seamlessly joined with the second set, ensuring integrated functionality.

The process flow terminates at end oval 1312

The floor plumbing can move up when trying to mate with plumbing in the wall module. The floor module is installed on a wall module with wall plumbing and the wall plumbing can push up the floor plumbing at the mating connector. Once the floor module is in place then the connection between the wall module's rigid pipes and the floor module's rigid pipes can be mated to take the floor module's ridged pipe down lower in the elongated opening.

Similarly, when the wall module has plumbing can get pushed up by the mating floor rigid pipe and once the wall module is in place, then the connector can be properly connected and the wall module rigid pipes can be connected and the wall module plumbing can lower in the elongated opening.

The elongated opening can be uses similarly for rigid pipes between wall modules when mated with other wall modules. This also allows to install the underfloor layer of the floor at a later stage and provide multiple varieties of structural types that haven't been done before in prefabricated construction like monolithic concrete pour, wood/concrete or other types of subfloor materials, precast concrete and others. The mechanism works by being able to lift the wall plumbing up and allows for drilling the plumbing hole in the floor system using the pre-cut steel hole and by having the plumbing physically moved temporarily from the hole.

Figure 14:
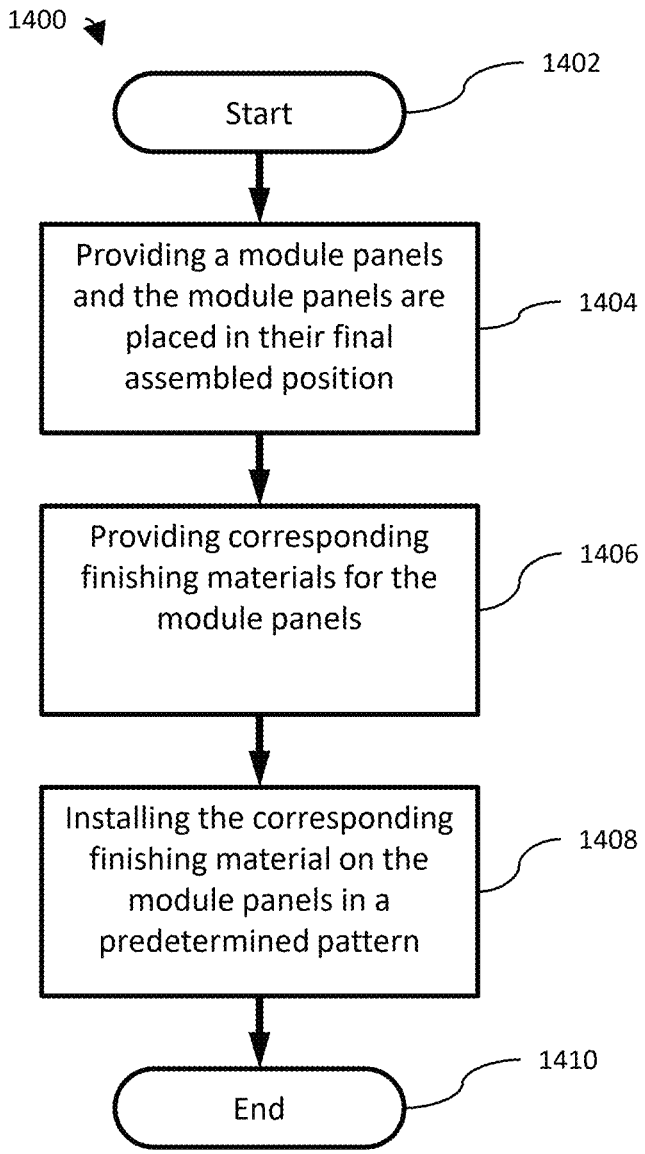

FIG. 14 provides a flow chart 1400 of how the pre-cut finishing materials (example, drywall) can be installed on corresponding modular panel.

After starting at start oval 1402, the process continues at box 1404 where a modular planal is provided, for example at a construction site and the modular panels are placed in their final assembled position.

Next at box 1406 finishing material for the model panel is provided, for example at a construction site.

Notably, these finishing materials are organized in a unique order that expedites the task of closing the module panel. Once this preparation stage is accomplished, the process advances to the next step where these predetermined finishing materials are installed onto the module panel following a specific predefined pattern.

The module panel is characterized by distinct areas: a bottom, a top, and a bottom left. The predefined pattern for the installation of finishing materials is set to commence from the bottom left of the panel. From here, the installation moves upwards to the top of the panel. Upon reaching the top, the installation process then shifts rightwards, returning again to the bottom of the panel. The upward installation towards the top is then repeated. This creates a systematic and repetitive pattern that starts from the bottom left, goes up to the top, shifts right, and repeats the cycle, ensuring a consistent, effective, and efficient construction process.

Finally, at box 1408 the finishing material on the module panels is installed in a predetermined pattern.

The flow chart ends at end oval 1410.

What is claimed is:

1. A modular panel construction system comprising:

a set of modular panels, each modular panel including:

a length, a width, and a shorter cross-sectional depth that is less than the length and the width;

a customized metal frame member having at least one cutout;

a building service routed through the at least one cutout;

where the building service is pre-installed in the modular panel and includes a portion configured to extend beyond an edge of the modular panel for connection with a corresponding building service in an adjacent modular panel of said set of modular panels;

at least one side is open for visual inspection after the modular panels are connected;

where the set of modular panels are designed to interconnect to form a portion of a building structure; and where the at least one cutout in the customized metal frame member are positioned to align with routing paths of the building service that extend across multiple modular panels in the set of modular panels when the modular panels are assembled in the building structure; and where the set of modular panels create all interior walls, floors, and ceilings of a building.

2. A modular panel construction system comprising:

a set of modular panels, each modular panel including:

a length, a width, and a shorter cross-sectional depth that is less than the length and the width;

a customized metal frame member having at least one cutout;

a building service routed through the at least one cutout;

where the building service is pre-installed in the modular panel and includes a portion configured to extend beyond an edge of the modular panel for connection with a corresponding building service in an adjacent modular panel of said set of modular panels;

at least one side is open for visual inspection after the modular panels are connected;

where the set of modular panels are designed to interconnect to form a portion of a building structure; and where the at least one cutout in the customized metal frame member are positioned to align with routing paths of the building service that extend across multiple modular panels in the set of modular panels when the modular panels are assembled in the building structure;

where the set of modular panels includes at least two unique wall modular panels and at least one unique floor modular panel and at least one unique ceiling modular panel, where the unique wall modular panels, the at least one unique floor modular panel, and the at least one unique ceiling modular panel are configured to interconnect to form at least a part of a defined space within the building structure where the defined space includes:

the at least two unique wall modular panels connected to form two vertical sides of the defined space, the at least one unique floor modular panel forming a bottom of the defined space, and the at least one unique ceiling modular panel forming a top of the defined space, where the interconnectable building services between the unique wall modular panels, unique floor modular panel, and unique ceiling modular panel of the defined space are designed to align and connect with building services in adjacent modular panels when assembled in a building.

3. A modular panel construction system comprising:

a set of modular panels, each modular panel including:

a length, a width, and a shorter cross-sectional depth that is less than the length and the width;

a customized metal frame member having at least one cutout;

a building service routed through the at least one cutout;

where the building service is pre-installed in the modular panel and includes a portion configured to extend beyond an edge of the modular panel for connection with a corresponding building service in an adjacent modular panel of said set of modular panels;

at least one side is open for visual inspection after the modular panels are connected;

where the set of modular panels are designed to interconnect to form a portion of a building structure; and where the at least one cutout in the customized metal frame member are positioned to align with routing paths of the building service that extend across multiple modular panels in the set of modular panels when the modular panels are assembled in the building structure;

wherein the set of modular panels includes at least two unique wall modular panels and at least one unique floor modular panel and at least one unique ceiling modular panel, where the unique wall modular panels, the at least one unique floor modular panel, and the at least one unique ceiling modular panel are configured to interconnect to form at least a part of a defined space within the building structure where the defined space includes:

the at least two unique wall modular panels connected to form two vertical sides of the defined space, the at least one unique floor modular panel forming a bottom of the defined space, and the at least one unique ceiling modular panel forming a top of the defined space, where the interconnectable building services between the unique wall modular panels, unique floor modular panel, and unique ceiling modular panel of the defined space are designed to align and connect with building services in adjacent modular panels when assembled in a building; and where the at least one unique ceiling modular panel is a floor modular panel for a next story in the building.

* * * * *